US006446684B1

(12) United States Patent
Hiramoto et al.

(10) Patent No.: US 6,446,684 B1
(45) Date of Patent: Sep. 10, 2002

(54) BAG OPENING APPARATUS AND METHOD FOR USE IN BAG FILLING AND PACKAGING MACHINE USING FLAT BAGS

(75) Inventors: Shinichi Hiramoto; Sumio Fukuda, both of Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 09/971,795

(22) Filed: Oct. 5, 2001

(30) Foreign Application Priority Data

Oct. 26, 2000 (JP) ..... 2000-327467

(51) Int. Cl.[7] ..... B65B 3/16

(52) U.S. Cl. ..... 141/114; 141/10; 141/313; 141/315

(58) Field of Search ..... 141/10, 114, 68, 141/313, 314, 315, 316, 166; 53/384.1, 385.1, 386.1, 492

(56) References Cited

U.S. PATENT DOCUMENTS 2,235,942 A * 3/1941 Moore
2,548,222 A * 4/1951 Kindseth
3,785,410 A * 1/1974 Carter
3,973,603 A * 8/1976 Franz

FOREIGN PATENT DOCUMENTS

JP 2981952 6/1992
JP 405178330 A * 7/1993

* cited by examiner

*Primary Examiner*—David J. Walczak
*Assistant Examiner*—Khoa Huynh
(74) *Attorney, Agent, or Firm*—Galgano & Burke

(57) ABSTRACT

A bag opening apparatus and method for use in a bag filling and packaging machine using flat bags allow a bag to move to a subsequent step while being surely maintained in the state of having been opened. At a mouth opening step, the mouth portion of a bag is opened by using suction cups serving as a mouth opening device. Next, an abutting member of a bag bottom deforming device is moved upward to abut on the bottom of the bag, thereby deforming at least a part of the bottom inward of the bag, while restraining movement of a lower portion of the bag with retaining plates of a bag movement restraining device.

13 Claims, 4 Drawing Sheets

BAG OPENING APPARATUS AND METHOD FOR USE IN BAG FILLING AND PACKAGING MACHINE USING FLAT BAGS

BACKGROUND OF THE INVENTION

1. Field of the Invention

The present invention relates to an apparatus and method for opening bags used in a bag filling and packaging machine. More particularly, the present invention relates to a bag opening apparatus and method for use in a bag filling and packaging machine using flat bags as packaging bags. It should be noted that the term "flat bags" as used herein includes the type that has a chuck at the bag mouth portion.

2. Discussion of Related Art

There is a conventional bag filling and packaging machine of the type in which an operation of opening a bag and an operation of filling the bag with a material to be packed are carried out at the same step. With this type of packaging machine, however, the processing time at each step becomes undesirably long. Therefore, the operating speed of the packaging machine cannot be increased. To cope with this problem, one type of conventional bag filling and packaging machine adopts a method wherein a bag opening step and a filling step are carried out separately from each other. That is, a bag is opened at the bag opening step, and the bag thus opened is moved to the filling step to fill it with a material to be packed.

With the above-described method, however, some problems may arise when flat bags are used. That is, the mouth of a flat bag is opened by pulling the bag from both sides using suction cups, for example, and in this state, air is sent into the bag from the mouth to open the bag as far as the bottom thereof. The bag thus opened may be undesirably closed during movement to the subsequent step, i.e. filling step, by the action of air resistance applied to the bag during the movement, or by the bag's own restoring force or the like. A bag undesirably closed in this way may interfere with the filling operation.

To solve the above-described problem, Japanese Pat. No. 2981952 discloses an apparatus having a driving arm adapted to reciprocate between a bag opening step and a filling step. The apparatus further has an opening and closing arm secured to the driving arm and a mouth opening claw attached to the opening and closing arm. The opening and closing arm and the mouth opening claw are opened and closed by using a cam and a cam follower. At the bag opening step, the driving arm is moved downward to insert the closed mouth opening claw into a bag having its mouth opened with suction cups. When the bag is moved to the filling step, the cam follower separates from the cam, thereby expanding the opening and closing arm to open the bag as far as the bottom thereof. In this state, the driving arm is moved to the filling step, together with the bag. After a filling hopper has been inserted into the mouth of the bag, the driving arm is moved upward so as to be removed from the bag. Thereafter, the driving arm is returned to the bag opening step, and the cam follower is brought into abutting contact with the cam to close the mouth opening claw.

With the arrangement of the above-described apparatus, the bag is transferred from the bag opening step to the filling step while being maintained in the open state by the mouth opening claw. Therefore, the problem that the bag is undesirably closed will not occur.

However, in the bag opening apparatus that moves in such a manner as to follow the movement of the bag from the bag opening step to the filling step, it is necessary to return the driving arm from the filling step to the bag opening step in order to open the subsequent bag. Therefore, the apparatus requires time for returning the driving arm. This limits the achievement of an increase in the operating speed of the packaging machine. Further, the apparatus itself becomes complicated and costly. In addition, the operating efficiency lowers in maintenance or a cleaning operation.

SUMMARY OF THE INVENTION

The present invention was made in view of the above-described problems associated with the prior art.

Accordingly, an object of the present invention is to provide a bag opening apparatus and method for flat bags that is capable of moving a bag opened at a bag opening step to a filling step while surely maintaining the bag in the state of being open and also capable of attaining an increase in the operating speed of packaging machines.

Another object of the present invention is to provide a bag opening apparatus and method for flat bags that is simple in arrangement and capable of being provided at low costs and that is excellent in operating efficiency in maintenance and so forth.

To attain the above-described problems, the present invention provides a bag opening apparatus including a mouth opening device for opening a mouth portion of a bag. The apparatus further includes a bag bottom deforming device for deforming at least a part of the bottom of the bag inward of the bag whose mouth portion has been opened by the mouth opening device. Further, the apparatus includes a bag movement restraining device for restraining movement of a portion of the bag in the vicinity of the bottom thereof, particularly the movement of that portion in a direction approximately perpendicular to a planar portion of the bag, so that the movement is restricted within predetermined limits.

The bag bottom deforming device may include an abutting member for abutting on the bottom of the bag to deform the bottom inward of the bag and an elevating-and-lowering device for vertically moving the abutting member. More specifically, the abutting member may be a rod-shaped member. The abutting member is brought into abutting contact with the bottom of the bag at an approximately central portion in the width direction of the bag and moved upward by the elevating-and-lowering device to deform the bottom of the bag.

More specifically, the bag movement restraining device may be formed from retaining plates disposed at both sides of the bag so as to face each other across the bag. The retaining plates are capable of moving toward and away from each other. The retaining plates have bag movement restraining portions arranged such that when the retaining plates move toward each other, the bag movement restraining portions face each other across each side edge portion of the bag over a predetermined height range from the bottom of the bag.

In addition, the present invention provides a bag opening method including the step of opening the mouth of a bag and the step of deforming the bottom of the bag inward of the bag. The method may further include the step of restraining a portion of the bag in the vicinity of the bottom thereof from moving in a direction approximately perpendicular to a planar portion of the bag when the bottom of the bag is deformed.

Other objects and advantages of the present invention will become apparent from the following detailed description of illustrated embodiments of the invention.

DETAILED DESCRIPTION OF THE PREFERRED EMBODIMENTS

Figure 1:
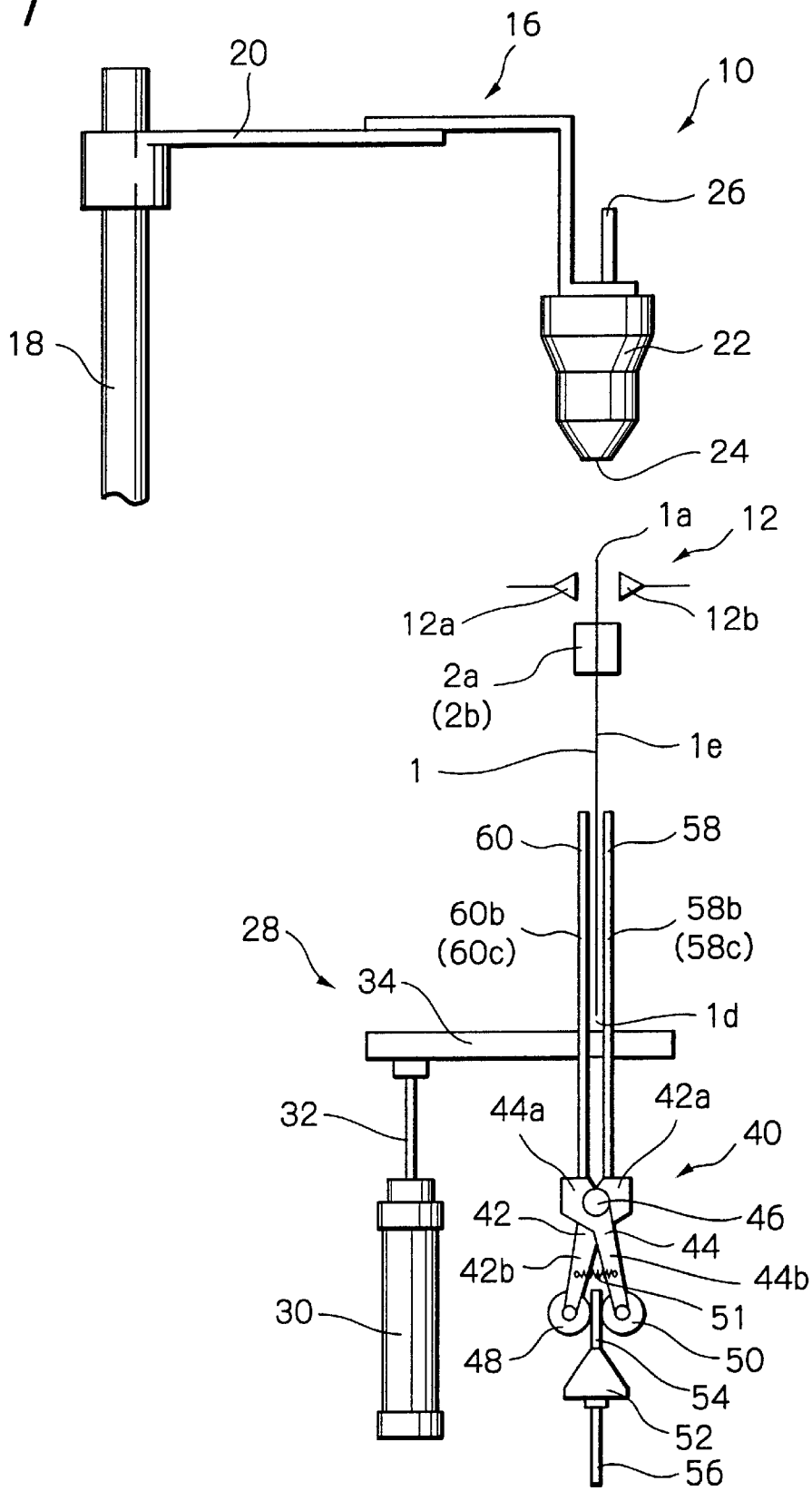
FIG. 1 is a side view showing the arrangement of a bag opening apparatus according to an embodiment of the present invention, which also shows an air inflating device schematically.

Specific embodiments of the present invention will be described below with reference to the accompanying drawings. FIG. 1 is a side view showing the arrangement of a bag opening apparatus 10 used at a bag opening step. FIGS. 2*a* to 4*d* are front, side and plan views showing a bag opening operation performed by using the bag opening apparatus 10.

In the figures, reference numeral 1 denotes a bag known as "flat bag", which is used for bag filling and packaging. The bag 1 is gripped with a pair of grippers 2*a* and 2*b* serving as one of gripping devices provided at predetermined spaces on a rotary table (not shown) of a packaging machine. More specifically, the bag 1 is gripped with the grippers 2*a* and 2*b* at both side edges 1*b* and 1*c* slightly below a bag mouth portion 1*a* (see FIG. 2*a*). In this state, the bag 1 moves through various bag filling and packaging steps successively as the table rotates. Publicly known gripping devices are usable as the grippers 2*a* and 2*b*. Therefore, a description thereof is omitted. In FIG. 1, the bag 1 moves to the illustrated position from the preceding step provided at the front or back side of the plane of the figure and stops there for a predetermined period of time.

The bag opening apparatus 10 in this embodiment has a bag mouth opening device 12 for opening the bag mouth portion 1*a*. The bag mouth opening device 12 has a pair of suction cups 12*a* and 12*b* connected to a vacuum source (not shown). The suction cups 12*a* and 12*b* are positioned to face both sides of the bag 1, which is gripped with the grippers 2*a* and 2*b*, in the vicinity of the bag mouth portion 1*a* at an approximately central position in the width direction of the bag 1. The suction cups 12*a* and 12*b* stick to the bag 1 by vacuum from both sides and then retract to thereby open the bag mouth portion 1*a*. This bag mouth opening device 12 is publicly known. Therefore, a detailed description thereof is omitted.

An inflating device 16 is positioned so as to lie above the bag 1 to blow air into the bag 1 from the mouth portion 1*a* that is held open, thereby opening the bag 1 as far as a bottom 1*d* thereof. The inflating device 16 has an elevating shaft 18 that is moved vertically by a drive source (not shown). An arm 20 is secured to the elevating shaft 18 to extend sideward. An air nozzle 22 is supported by the arm 20 in such a manner that an air outlet 24 faces downward at the lower end of the nozzle 22. An air inlet 26 of the nozzle 22 is connected to a compressed air source (not shown). This type of inflating device 16 is publicly known. Therefore, a further detailed description thereof is omitted.

The bag opening apparatus 10 according to this embodiment has a bag bottom deforming device 28 and a bag movement restraining device 40 in addition to the above-described bag mouth opening device 12 and inflating device 16. The bag bottom deforming device 28 deforms the bottom 1*d* of the bag 1 as described later. The bag bottom deforming device 28 has an air cylinder 30 installed on the base frame (not shown) of the packaging machine. The air cylinder 30 has a cylinder rod 32 adapted to extend or contract in response to the operation of the air cylinder 30. A bag bottom abutting member 34 is secured to the distal end of the cylinder rod 32 to extend sideward. In this embodiment, the abutting member 34 is a rod member having a circular sectional configuration. As shown in FIGS. 1 to 3*e*, the abutting member 34 extends under the bottom id of the bag 1 at an approximately central portion in the lateral direction of the bag 1 gripped with the grippers 2*a* and 2*b*, at an approximately right angle to a plane in which a planar portion 1*e* of the bag 1 extends. When the rod 32 moves upward, the abutting member 34 comes in abutting contact with the bottom 1*d* of the bag 1 and pushes it up, thereby deforming the bottom 1*d* as described later.

The bag movement restraining device 40 restrains movement of at least a part of the bag 1 in the vicinity of the bottom 1*d*, particularly the movement thereof in a direction approximately perpendicular to the planar portion 1*e* of the bag 1, when the bag bottom deforming device 28 performs the operation of deforming the bottom 1*d* of the bag 1. More specifically, when the bottom 1*d*, of the bag 1 is pushed up with the abutting member 34, the bag movement restraining device 40 prevents the bottom 1*d* of the bag 1 from moving along the abutting member 34 in the longitudinal direction of the abutting member 34.

The bag movement restraining device 40 has a pair of opening and closing arms 42 and 44 pivotally supported by a pivot shaft 46 secured to the base frame (not shown). The opening and closing arms 42 and 44 respectively have upper portions 42*a* and 44*a* above the pivot shaft 46 and lower portions 42*b* and 44*b* below the pivot shaft 46. The opening and closing arms 42 and 44 are arranged to intersect each other at the pivot shaft 46 in an approximately X-shaped configuration.

The opening and closing arms 42 and 44 have rollers 48 and 50 rotatably attached to the lower ends of the lower portions 42*b* and 44*b*. A tension spring 51 is provided between predetermined positions of the lower portions 42*b* and 44*b*, as shown in FIG. 1, to urge the opening and closing arms 42 and 44 in respective directions in which the rollers 48 and 50 come toward each other. Below the opening and closing arms 42 and 44, an opening and closing cam 52 having an approximately triangular pyramid-like shape is placed with its vertex side facing upward. The opening and closing cam 52 is secured to the distal end of a cam elevating shaft 56 driven to move vertically through a predetermined distance by a driving device (not shown). FIG. 1 shows the bag movement restraining device 40 in a state where the opening and closing cam 52 is in a lowered position. In this state, a guide member 54 secured to the distal end of the cam 52 is located between the rollers 48 and 50 to separate the rollers 48 and 50 from each other by a predetermined distance. When the opening and closing cam 52 moves upward, the rollers 48 and 50 are gradually moved away from each other. Consequently, the opening and closing arms 42 and 44 open.

Retaining plates 58 and 60 are secured to the respective ends of the upper portions 42*a* and 44*a* of the opening and closing arms 42 and 44. As shown in FIGS. 2*a* to 2*e*, the retaining plates 58 and 60 have a U-shaped configuration. That is, the upper ends of the retaining plates 58 and 60 are open. In the state illustrated in FIG. 1, the retaining plates 58 and 60 face each other across the bag 1 at respective positions close to each other. Consequently, a pair of mutually opposing vertical portions 58*b* and 60*b* of the retaining plates 58 and 60 and another pair of mutually opposing vertical portions 58*c*and 60*c* thereof face each other across the lower portions of the bag side edges 1*b* and 1*c*, respectively. The abutting member 34 of the bag bottom deforming device 28 extends through a space defined between the bottom 1*d* of the bag 1, the horizontal portions 58*a* (60*a*) of the retaining plates 58 and 60, the vertical portions 58*b* and 58*c* of the retaining plate 58, and the vertical portions 60*b* and 60*c* of the retaining plate 60. When the opening and closing cam 52 moves upward to open the opening and closing arms 42 and 44, the retaining plates 58 and 60 move away from each other.

Next, the operation of the bag opening apparatus 10 arranged as stated above will be described. In a standby state, the suction cups 12*a* and 12*b* of the bag mouth opening device 12 are separate from each other, and the air nozzle 22 of the inflating device 16 is at a raised position. The abutting member 34 of the bag bottom deforming device 28 is at a lowered position. The opening and closing cam 52 of the bag movement restraining device 40 is at a raised position. Accordingly, the retaining plates 58 and 60 are away from each other.

The bag 1 gripped with the grippers 2*a* and 2*b* as stated above is sent to the bag opening apparatus 10 standing by in the above-described state. When the bag 1 stops at the bag opening apparatus 10, the opening and closing cam 52 moves downward to allow the retaining plates 58 and 60 to face each other across the bag 1 at respective positions close to each other, as shown in FIG. 1. Thus, the vertical portions 58*b* and 60*b* of the retaining plates 58 and 60 and the vertical portions 58*c* and 60*c* thereof face each other across the lower portions of the bag side edges 1*b* and 1*c*, respectively. At almost the same time or with a predetermined time delay, the suction cups 12*a* and 12*b* approach the bag 1 from both sides thereof and stick to both sides of the planar portion 1*e* of the bag 1 by vacuum (see FIGS. 2*a*, 3*a* and 4*a*). Then, the suction cups 12*a* and 12*b* move away from each other, thereby opening the mouth portion 1*a* of the bag 1. At this time, the grippers 2*a* and 2*b* move toward each other to allow the suction cups 12*a* and 12*b* to move smoothly without hindrance (see FIGS. 2*b*, 3*b* and 4*b*). It should be noted that the vertical portions 58*b*, 60*b*, 58*c* and 60*c* need not come in close contact with the side edges 1*b* and 1*c* of the bag 1. The vertical portions 58*b*, 60*b*, 58*c* and 60*c* only need to be capable of preventing the lower portion of the bag 1 from moving in a direction perpendicular to the planar portion 1*e* of the bag 1 to such an extent that there will be no interference with the operation of deforming the bag bottom 1*d* by the abutting member 34 (described later). Therefore, a gap may be present between the bag 1 and the vertical portions 58*b*, 60*b*, 58*c* and 60*c* as long as it is possible to prevent movement of the lower portion of the bag 1 in a direction perpendicular to the planar portion 1*e*.

Figures 2A, 2B, 2C, 2D, 2E:
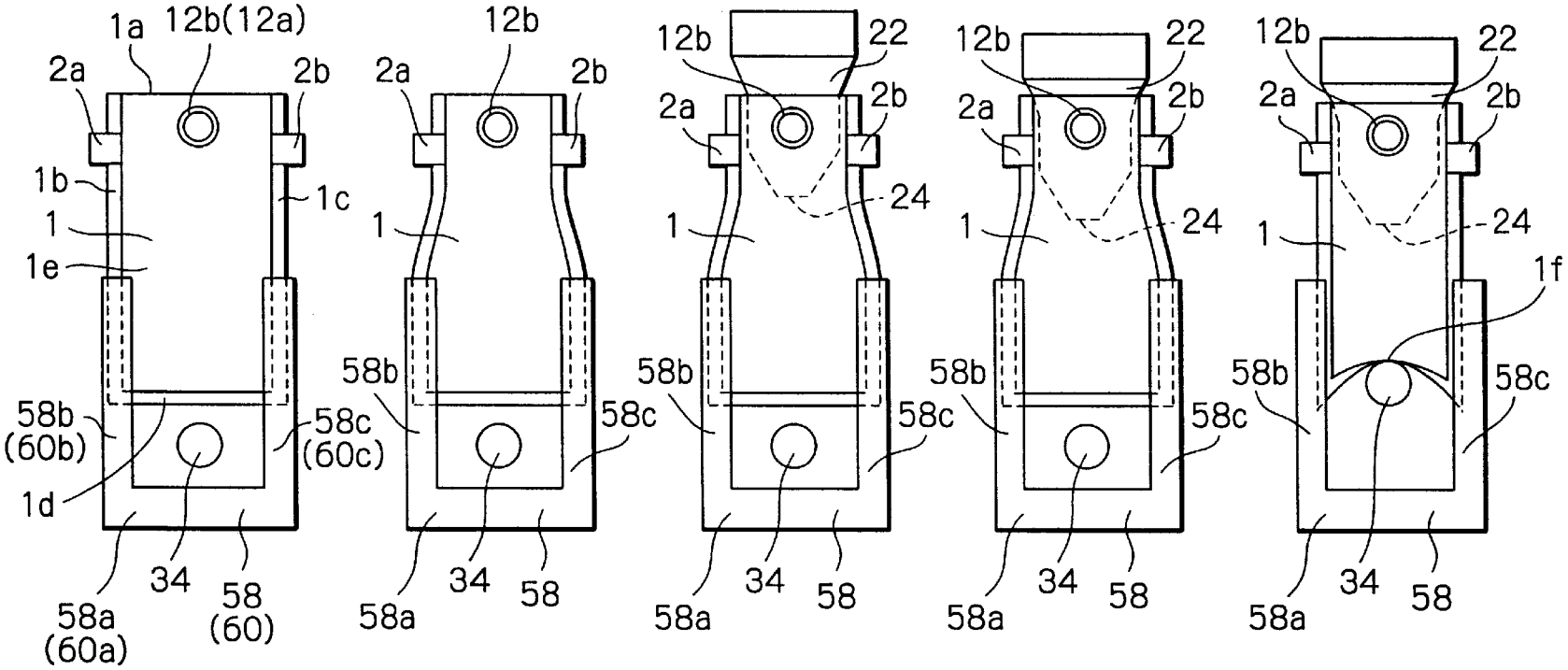
FIGS. 2*a* to 2*e* are front views showing a bag opening operation performed with the bag opening apparatus shown in FIG. 1.
Figures 3A, 3B, 3C, 3D, 3E:
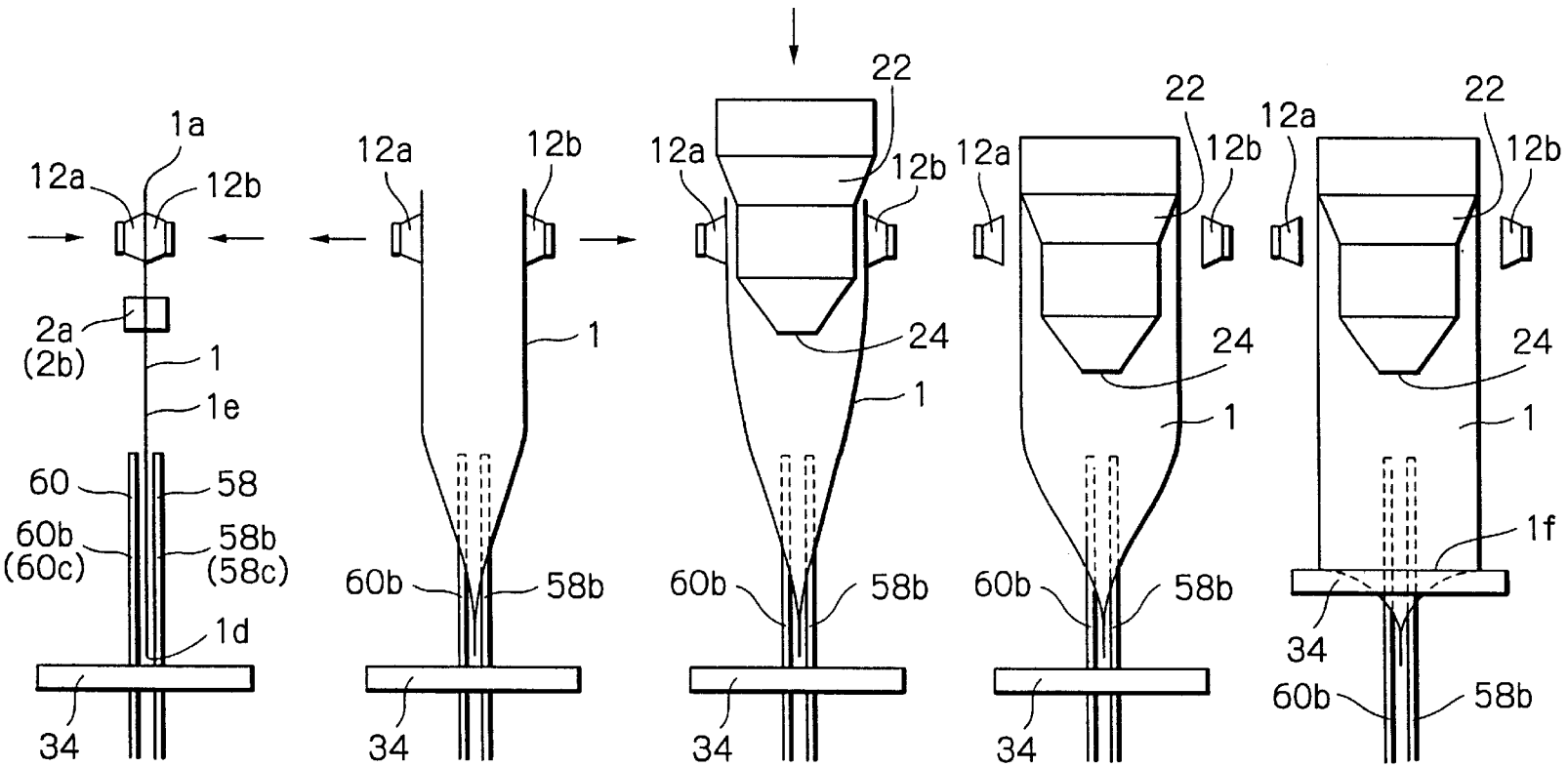
FIGS. 3*a* to 3*e* are side views showing the bag opening operation.
Figure 4A:
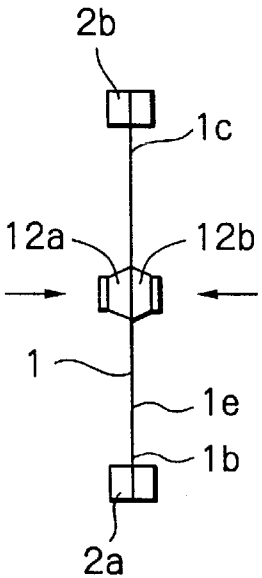
FIGS. 4*a* to 4*d* are plan views showing the bag opening operation.
Figure 4B:
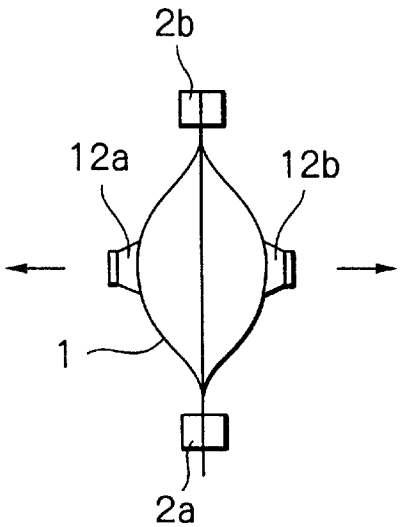
Figure 4C:
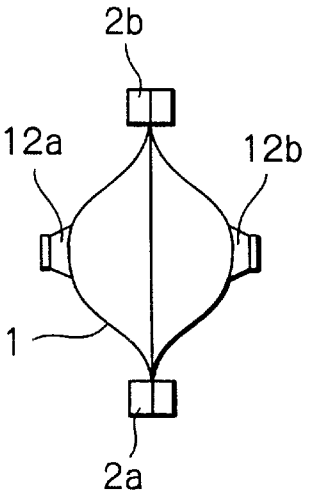
Figure 4D:
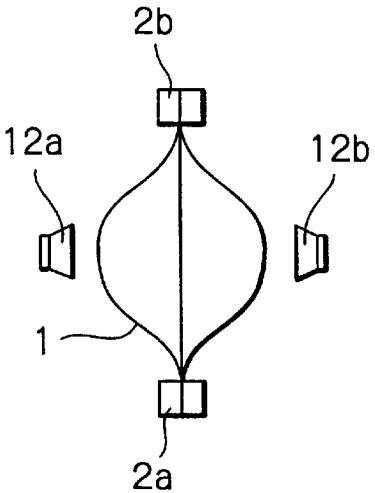

In parallel to the progress of the operation of opening the bag mouth portion 1*a*, the nozzle 22 of the inflating device 16 moves downward to enter the bag mouth portion 1*a* and begins to blow air into the bag 1 (see FIGS. 2*c*, 3*c* and 4*c*). The suction cups 12*a* and 12*b* continue to move away from each other. However, the grippers 2*a* and 2*b* stop their approaching operation at a predetermined position. Consequently, the suction cups 12*a* and 12*b* become unable to pull the mouth portion 1*a* of the bag 1 further and hence separate from the bag 1. Meantime, the nozzle 22 continues to move downward and to blow air into the bag 1. Thus, the bag 1 is fully opened as far as the bottom 1*d* (see FIGS. 2*d*, 3*d* and 4*d*).

Then, the abutting member 34 of the bag bottom deforming device 28 moves upward to push up the bottom 1*d* of the bag 1 over a certain area of the central portion in the width direction of the bag 1, thereby deforming the bottom 1*d*. At this time, the nozzle 22 stops blowing air into the bag 1. Thus, the central portion of the bottom 1*d* is formed into an approximately planar shape extending in a direction approximately perpendicular to the planar portion 1*e* of the bag 1. In other words, the planar portion 1*e* of the bag 1 rises from each side edge of the planar bottom portion 1*f* at approximately right angles thereto (see FIGS. 2*e* and 3*e*). It should be noted that when the operation of deforming the bag bottom 1*d* is carried out, the vertical portions 58*b* and 60*b* of the retaining plates 58 and 60 and the vertical portions 58*c* and 60*c* thereof face each other across the bag side edges 1*b* and l*c*, respectively, to prevent the bag 1 from moving or falling, as has been stated above. Accordingly, the bag bottom deforming operation is carried out extremely smoothly.

After stopping blowing air, the nozzle 22 begins to move upward and returns to the previous position. Then, the abutting member 34 moves downward to return to the previous position. Meanwhile, the opening and closing cam 52 moves upward to separate the retaining plates 58 and 60 from each other. It should be noted that the suction cups 12*a* and 12*b* separated from the bag 1 ahead of the bag bottom deforming operation have already returned to the previous positions, respectively, and the vacuum action derived from the vacuum source has also already stopped.

Thus, the bag opening operation is completed. Then, the bag. 1 moves to the subsequent step, i.e. filling step. As has been stated above, the bag 1 has the bottom 1*d* deformed into a planar shape over a certain area at the central portion in the width direction, and the planar portion 1*e* of the bag 1 rises from each side edge of the planar bottom Portion 1*f* at approximately right angles thereto. This structure provides sufficiently strong shape retaining force to prevent the bag 1 from being undesirably closed by the action of air resistance during the movement of the bag 1. In addition, because the bag 1 is deformed into the above-described shape, the bag's own restoring force as described in connection with the prior art is kept from acting.

Although in the foregoing embodiment the bag movement restraining device 40 is provided separately from the bag bottom deforming device 28, it should be noted that a bag movement restraining device may be provided in the bag bottom deforming device 28. That is, in another embodiment of the present invention, the upper portion of the outer periphery of the abutting member 34 is formed with a groove extending in a direction perpendicular to the longitudinal direction of the abutting member 34 so that when the abutting member 34 is moved upward, the edge portion of the bottom 1*d* of the bag 1 enters the groove first, thereby restraining the movement of the bag bottom 1*d*. By further moving the abutting member 34 upward, the bag bottom id is deformed as stated above.

As has been stated above, according to the present invention, after the mouth portion of a bag has been opened, the bottom of the bag is deformed inward of the bag, thereby forming a portion of the bag bottom into a planar shape similar to the flat bottom of a self-supporting bag. Thus, the shape of the bag is changed so that each surface portion of the bag extends from an edge of the planar bottom portion at approximately right angles thereto. Therefore, the opened bag is firmly maintained in this state. Accordingly, there is no likelihood that the opened bag may be closed by the bag's own restoring force or air resistance applied to the bag during movement to the subsequent step. Moreover, the present invention does not use a member that reciprocates between the bag opening step and the subsequent step as has been stated in connection with the prior art. Therefore, it is unnecessary to take into consideration the reset operation time of such a member. Accordingly, it is possible to increase the operating speed of packaging machines.

Further, both the bag bottom deforming device and the bag movement restraining device can be simplified in arrangement. Therefore, the production cost is favorably low, and maintenance and other operations can be performed easily.

It should be noted that the present invention is not limited to the foregoing embodiments but can be modified in a variety of ways.

What is claimed is:

1. A bag opening apparatus for use in a bag filling and packaging machine using a flat bag, said apparatus comprising:

a mouth opening device for opening a mouth portion of said bag, said bag being empty and delivered to said mouth opening device with a mouth portion thereof being closed;

a bag bottom deforming device for deforming at least a part of a bottom of said empty bag inward of said empty bag whose mouth portion has been opened by said mouth opening device; and a bag movement restraining device for restraining movement of a portion of said empty bag in a vicinity of the bottom of said empty bag in a direction approximately perpendicular to a planar portion of said bag so that said movement is restricted within predetermined limits, said bag movement restraining device having restraining members, said restraining members being capable of moving between a first position where said restraining members are positioned adjacent both sides of said bag so as to face each other across said bag and restrain said movement of said portion of said empty bag in a direction approximately perpendicular to the planar portion of said bag and a second position where said restraining members are positioned apart from said bag so as not to restrain movement of said bag.

2. A bag opening apparatus according to claim 1, wherein said restraining members are restraining plates which are disposed at both sides of said bag so as to face each other across said bag, said restraining plates being capable of moving toward and away from each other.

3. A bag opening apparatus according to claim 2, wherein said retaining plates have respective bag movement restraining portions arranged such that when said retaining plates move toward each other, said bag movement restraining portions face each other across each side edge portion of said bag over a predetermined height range from the bottom of said bag.

4. A bag opening-apparatus according to claim 1, wherein said bag bottom deforming device includes:

an abutting member for abutting on the bottom of said bag to deform said bottom inward of said bag; and an elevating-and-lowering device for vertically moving said abutting member.

5. A bag opening apparatus according to claim 4, wherein said retaining members are retaining plates which are disposed at both sides of said bag so as to face each other across said bag, said retaining plates being capable of moving toward and away from each other.

6. A bag opening apparatus according to claim 5, wherein said retaining plates have respective bag movement restraining portions arranged such that when said retaining plates move toward each other, said bag movement restraining portions face each other across each side edge portion of said bag over a predetermined height range from the bottom of said bag.

7. A bag opening apparatus according to claim 5, wherein said abutting member is a rod-shaped member, said abutting member abutting on the bottom of said bag at an approximately central portion in a width direction of said bag to deform the bottom of said bag.

8. A bag opening apparatus according to claim 7, wherein said retaining members are retaining plates which are disposed at both sides of said bag so as to face each other across said bag, said retaining plates being capable of moving toward and away from each other.

9. A bag opening apparatus according to claim 8, wherein said retaining plates have respective bag movement restraining portions arranged such that when said retaining plates move toward each other, said bag movement restraining portions face each other across each side edge portion of said bag over a predetermined height range from the bottom of said bag.

10. A bag opening apparatus for use in a bag filling and packaging machine using a flat bag, said apparatus comprising:

a mouth opening device for opening a mouth portion of said bag;

a bag bottom deforming device for deforming at least a part of a bottom of the bag inward of said bag whose mouth portion has been opened by said mouth opening device, said bag bottom deforming device including an abutting member for abutting on the bottom of said bag to deform said bottom inward of said bag, and an elevating-and-lowering device for vertically moving said abutting member, said abutting member being a rod-shaped member, and said abutting member, abutting on the bottom of said bag at an approximately central portion in a width direction of said bag to deform the bottom of said bag; and a bag movement restraining device for restraining movement of a portion of said bag in a vicinity of the bottom of said bag in a direction approximately perpendicular to a planar portion of said bag so that said movement is restricted within predetermined limits.

11. A bag opening apparatus for use in a bag filling and packaging machine using a flat bag, said apparatus comprising:

a mouth opening device for opening a mouth portion of said bag;

a bag bottom deforming device for deforming at least a part of a bottom of the bag inward of said bag whose mouth portion has been opened by said mouth opening device; and a bag movement restraining device for restraining movement of a portion of said,bag in a vicinity of the bottom of said bag in a direction approximately perpendicular to a planar portion of said bag so that said movement is restricted within predetermined limits, said bag movement restraining device having retaining plates disposed at both sides of said bag so as to face each other across said bag, said retaining plates being capable of moving toward and away from each other, said retaining plates having bag movement restraining portions arranged such that when said retaining plates move toward each other, said bag movement restraining portions face each other across each side edge portion of said bag over a predetermined height range from the bottom of said bag.

12. A bag opening apparatus for use in a bag filling and packaging machine using a flat bag, said apparatus comprising:

a mouth opening device for opening a mouth portion of said bag;

a bag bottom deforming device for deforming at least a part of a bottom of the bag inward of said bag whose mouth portion has been opened by said mouth opening device, said bag bottom deforming device including, an abutting member for abutting on the bottom of said bag to deform said bottom inward of said bag, and an elevating-and-lowering device for vertically moving said abutting member; and a bag movement restraining device for restraining movement of a portion of said bag in a vicinity of the bottom of said bag in a direction approximately perpendicular to a planar portion of said bag so that said movement is restricted within predetermined limits, said bag movement restraining device having retaining plates disposed at both sides of said bag so as to face each other across said bag, said retaining plates being capable of moving toward and away from each other, said retaining plates having bag movement restraining portions arranged such that when said retaining plates move toward each other, said bag movement restraining portions face each other across each side edge portion of said bag over a predetermined height range from the bottom of said bag.

13. A bag opening apparatus for use in a bag filling and packaging machine using a flat bag, said apparatus comprising:

a mouth opening device for opening a mouth portion of said bag;

a bag bottom deforming device for deforming at least a part of a bottom of the bag inward of said bag whose mouth portion has been opened by said mouth opening device, said bag bottom deforming device including an abutting member for abutting on the bottom of said bag to deform said bottom inward of said bag, an elevating-and-lowering device for vertically moving said abutting member; and a bag movement restraining device for restraining movement of a portion of said bag in a vicinity of the bottom of said bag in a direction approximately perpendicular to a planar portion of said bag so that said movement is restricted within predetermined limits, said bag movement restraining device having retaining plates disposed at both sides of said bag so as to face each other across said bag, said retaining plates being capable of moving toward and away from each other, said retaining plates having bag movement restraining portions arranged such that when said retaining plates move toward each other, said bag movement restraining portions face each other across each side edge portion of said bag over a predetermined height range from the bottom of said bag.

* * * * *